219-121 SR

8/31/82 XR 4,347,419

United States Patent [19]

Jasper, Jr.

[11] 4,347,419

[45] Aug. 31, 1982

[54] TRAVELING-WAVE TUBE UTILIZING VACUUM HOUSING AS AN RF CIRCUIT

[75] Inventor: Louis J. Jasper, Jr., Ocean, N.J.

[73] Assignee: The United States of America as represented by the Secretary of the Army, Washington, D.C.

[21] Appl. No.: 140,345

[22] Filed: Apr. 14, 1980

[51] Int. Cl.[3] ..... H05B 6/64

[52] U.S. Cl. ..... 219/10.55 A; 219/121 PL; 219/121 L; 219/10.55 R; 29/600; 315/3.5; 315/3.6

[58] Field of Search ..... 219/10.55 A, 121 PL, 219/121 R, 10.55 R, 121 R; 29/600; 315/3.5, 3.6, 39.3; 333/31 A, 31 C

[56] References Cited

U.S. PATENT DOCUMENTS 3,504,223 3/1970 Orr et al. ..... 315/3.5

3,670,197 6/1972 Unger ..... 29/600

FOREIGN PATENT DOCUMENTS 1491432 5/1969 Fed. Rep. of Germany ..... 29/600

OTHER PUBLICATIONS

RCA #194, 1958, "Means for Supporting Magnetic Elements of Traveling Wave Tubes", Valva et al.

*Primary Examiner*—M. H. Paschall

*Attorney, Agent, or Firm*—Nathan Edelberg; Jeremiah G. Murray; Edward Goldberg

[57] ABSTRACT

A traveling-wave-tube has a vacuum housing that includes the helix rf circuitry. The helix conductor is intertwined with and hermetically sealed to the insulating material comprising the vacuum housing. Thus, portions of the helix serve for interaction with the electron beam in the center of the vacuum housing while other portions are in contact with the atmosphere, thus cooling the helix and permitting the tube to operate at higher average powers.

8 Claims, 10 Drawing Figures

MICROWAVE INPUT
MICROWAVE OUTPUT 14
16
27
28
10
23
21
17
19
26
18
13
29
12
11
22
24

12
13
11

13
11
12

32
31
33
DIELECTRIC SOURCE 43
41
42
44
LASER
METAL SOURCE 51
54
56
53
52
METAL SOURCE
DIELECTRIC SOURCE

TRAVELLING-WAVE TUBE UTILIZING VACUUM HOUSING AS AN RF CIRCUIT

GOVERNMENT LICENSE

The invention described herein may be manufactured and used by or for the Government for governmental purposes without the payment of any royalties thereon or therefor.

TECHNICAL FIELD

Broadly speaking, this invention relates to microwave devices. More particularly, in a preferred embodiment, this invention relates to a microwave device in which the vacuum housing of the device also functions as part of the rf circuitry.

DISCUSSION OF THE PRIOR ART

Existing microwave devices, such as travelling-wave tubes (TWT) and crossed-field amplifiers (CFA), are difficult and expensive to manufacture. There is, thus, considerable reluctance to employ them in expendable devices and in large numbers, for example in electronic countermeasure and radar jamming apparatus, weather transponders, etc. some of which have short operating lives and may be destroyed after deployment.

In addition, the average power output of prior art microwave devices is limited by the inability to adequately dissipate the heat which is generated within the devices. Consider, for example, the travelling wave tube in which a metal helix is concentrically supported within an elongated, evacuated, ceramic or metal cylinder which acts as a vacuum housing. The dielectric supports which maintain the alignment of the helix within the housing also serve to transfer heat to the cylinder walls, thence to the atmosphere, by conduction. However, even with the use of exotic dielectric materials having high heat conductivity, for example, diamond, the restriction that the dielectric supports can only dissipate the heat by conduction places a definite upper limit on the power that may be generated by such devices.

It is, therefore, an object of this invention to provide a microwave device that is relatively simple and inexpensive to manufacture yet which is free from the power limitations of the prior art devices.

SUMMARY OF THE INVENTION

The above, and other objectives, are attained by the instant invention which, in a preferred embodiment, comprises an improved microwave device of a type that includes an elongated, hollow, cylindrical dielectric vacuum housing; means sealing a first end of said housing including a heater, a cathode and an anode; means sealing a second end of said housing including a collector; a helix within said vacuum housing; and means coupling rf energy into and out of said helix. According to the invention, the improvement in said microwave device comprises the fact that the helix and the dielectric vacuum housing form a unitary, intertwined, hermetically-sealed structure with portions of the helix extending inwardly into the vacuum housing and other portions of the helix being in contact with the outside atmosphere.

The invention and its mode of operation will be more fully understood from the following detailed description, when taken with the appended drawings in which:

DETAILED DESCRIPTION OF THE INVENTION

The invention will now be described with reference to a particular microwave device—the travelling-wave tube with a helical rf circuit. One skilled in the art, however, will appreciate that the invention is not so limited but has equal application to travelling-wave tubes of the type that have meanderline or ring-bar rf circuits as well as to other microwave devices, such as cross-field amplifiers, and the like, which may also use helical, meanderline or vane-type rf circuitry.

Figure 1:
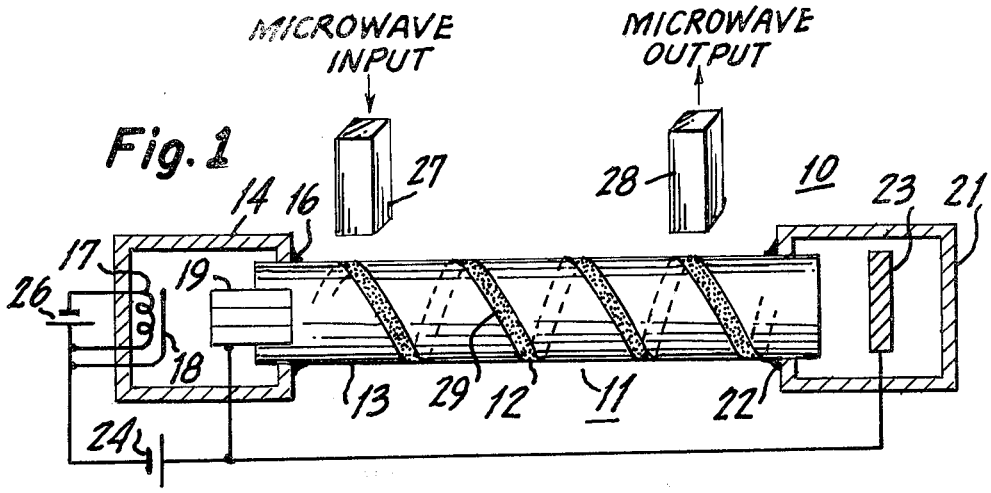
FIG. 1 is a partially schematic, partially cross-sectional view of an illustrative travelling-wave tube according to the invention.
Figure 2:
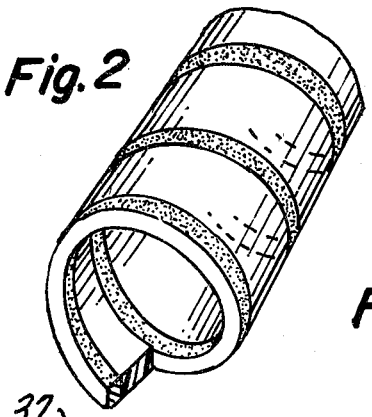
FIG. 2 is a partially cut away, isometric view of a portion of the vacuum housing for the travelling-wave tube shown in FIG. 1.

As shown in FIGS. 1 and 2, travelling-wave tube 10 comprises an elongated, cylindrical, vacuum housing 11 comprising a metallic helix 12 intertwined with and fused to a coaxial, dielectric material 13 of substantially the same outer diameter.

A first end cap 14 is hermetically sealed at 16 to one end of housing 11 and includes a heater 17, a cathode 18 and a gun anode 19. A second end cap 21, hermetically sealed at 22 to the other end of housing 11, includes a collector 23. Both collector 23 and anode 19 are connected to the positive terminal of a first voltage source 24, the negative terminal of which connects to cathode 18 and the positive terminal of a second voltage source 26 for the heater 17. Microwave energy is fed into the device via a first rf coupling input connection 27 which is positioned proximate one end of helix 12. The amplified microwave energy is extracted from the device by means of an rf coupling output connection 28 which is positioned proximate the other end of helix 12.

When voltage sources 26 and 24 are energized, an electron beam 29 is generated and will flow from cathode 18 to collector 23, in accordance with well known physical principles.

The operation of travelling-wave tubes, such as the tube shown in FIG. 1, is well known and need not be repeated in detail here. See for example, "Traveling Wave Tubes" by J. R. Pierce, Van Nostrand Company, Inc., New York (1950), particularly pages 5–18, inclusive, which publication is hereby incorporated by reference as if more fully set forth herein.

Figure 3:
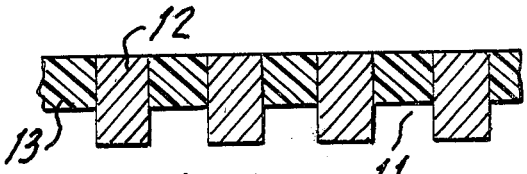
FIG. 3 is a cross-sectional view of a portion of the vacuum housing shown in FIG. 1.

FIG. 2 is a partially cut away, isometric view of vacuum housing 11 which shows that helix 12 is not merely wound about dielectric 13 but, according to the principles of this invention, is intertwined therewith and fused thereto. This arrangement is more clearly shown in FIG. 3, which is a partial cross-section of housing 11. FIG. 3 shows the manner in which alternate turns of helix 12 are spaced-apart and joined to corresponding portions of an intertwined dielectric "helix" 13 to form a unitary, hermetically-sealed, structure 11. In FIG. 3, it will be noted that the turns of helix 12 extend radially inward to a greater depth than the corresponding portions of the dielectric "helix" 13. This will be explained below.

The travelling-wave tube shown in FIG. 1 differs from the prior art travelling-wave tubes in that the rf circuit, in this case a helix, is not *inside* the vacuum housing but actually forms part *of* the vacuum housing. Some of the advantages which may be obtained by utilizing the vacuum housing as the rf circuit are:

(1) the tube can develop both higher peak power and higher average power since the rf circuit is exposed to both the electron beam 29 and to the outside atmosphere, for cooling;

(2) the conventional window through the walls of the vacuum housing needed to admit rf energy are eliminated and the rf energy may be coupled to the helix directly without having to pass through the walls of the vacuum housing;

(3) the use of axial vane loading is greatly facilitated since the axial vanes may be positioned outside of the vacuum housing;

(4) the use of variable vane loading, e.g. by either electrical and/or mechanical means, to change the dispersion characteristics of the tube are greatly facilitated. This is significant if dual-mode operation is contemplated;

(5) external diodes may be used to vary the dispersion characteristics of the tube. This makes feasible novel jamming techniques by electronic programming of the rf circuit characteristics;

(6) the use of sophisticated attenuation techniques and resonance loss techniques are facilitated since both can be accomplished outside the vacuum housing. Further, since these materials need not operate in a vacuum, materials which are not dependent upon vacuum integrity can be used, for example low cost attenuators can be applied by painting directly on the outside area of the rf circuit; and (7) construction or the expense of manufacturing the device is considerably reduced.

The importance of the heat transfer that is made possible by this arrangement cannot be over-emphasized. According to the invention, the outer surfaces of the helix will now act as radiators radiating out most of the heat generated on their inner surfaces by electron beam 29.

Figure 4:
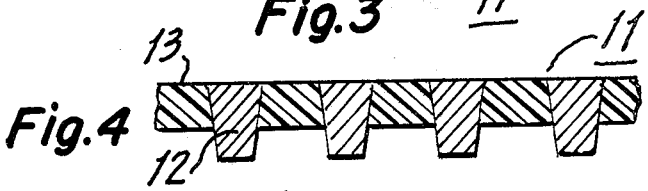
FIG. 4 is a cross-sectional view showing an alternate embodiment of the vacuum housing shown in FIG. 3.

As previously mentioned, portions of the helix 12 in FIG. 3 extend radially inward to a greater depth than the corresponding portions of the dielectric "helix" 13. The reason for this is that this arrangement reduces rf circuit loss because the electrons in beam 29 will travel closer to the metal helix. FIG. 4 shows an alternate arrangement in which the cross-section of the metallic helix is wedge-shaped. This arrangement further reduces rf loss and also tends to improve vacuum integrity.

Figure 5:
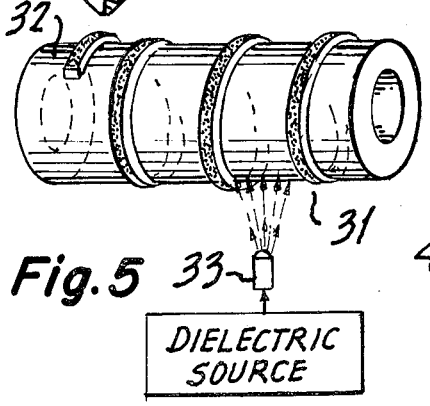
FIG. 5 depicts a method of forming the vacuum housing shown in FIGS. 1–4 utilizing an electrically conductive helix on a mandrel which is subjected to a plasma spray of dielectric material.
Figure 6:
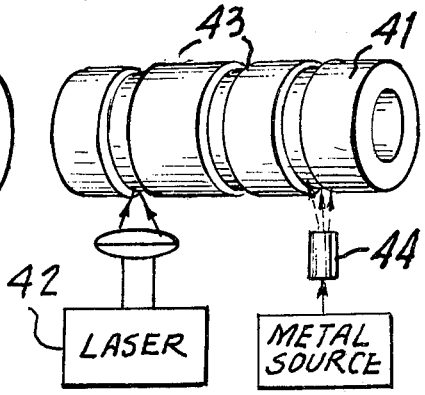
FIG. 6 is a diagram illustrating a method of forming the vacuum housing shown in FIGS. 1–4 by use of a laser machining technique and a plasma spray of an electrically conductive material.

Let us now consider the manner in which the vacuum housing shown in FIG. 1 may be manufactured. As shown in FIG. 5, one technique would be to start with a metal helix 31 fabricated in a conventional manner to the desired length and pitch. This helix would be placed over a mandrel 32 of appropriate outer diameter as shown. Next, a ceramic such as beryllia, alumina, or boron nitride is plasma-sprayed by means of a plasma gun 33 over the helix to fill the interstices between the turns thereof and slightly over the outer surface of the helix. Next, the excess ceramic material is machined-off or etched-off the outer surface of the vacuum housing until the desired "barber-pole" configuration is obtained. The mandrel may be constructed of a material such that the ceramic material which is plasma sprayed onto the mandrel will not adhere to it or it may be made of a material that may be easily etched. In either event, the mandrel is next separated from the vacuum housing to obtain the desired hollow, cylindrical vacuum member. If the helix is comprised of copper and if ceramic is used as the dielectric, then aluminum is suitable for use as the mandrel as it may be easily etched without affecting either the copper or the ceramic.

Another technique for manufacturing the vacuum housing according to the invention is to start with an elongated, hollow ceramic cylinder 41 then, by the use of a focused beam of radiant energy, e.g. from a laser 42, cut a series of helical grooves 43 within cylinder 41. Next, using a plasma gun 44, plasma deposit the metal which is to form the helix within the helical grooves 43 to a depth slightly greater than the depth of the grooves. Then, using either an abrasive or a chemical etch, remove the excess material from the vacuum housing 11 to obtain the desired "barber-pole" appearance. Note that it is possible to substitute conventional mechanical means for cutting the helical grooves within cylinder 41 rather than use laser machining. Note also that a grooved mandrel may be utilized in this technique which is then separated from the vacuum housing to obtain the desired hollow cylindrical member.

Figure 7:
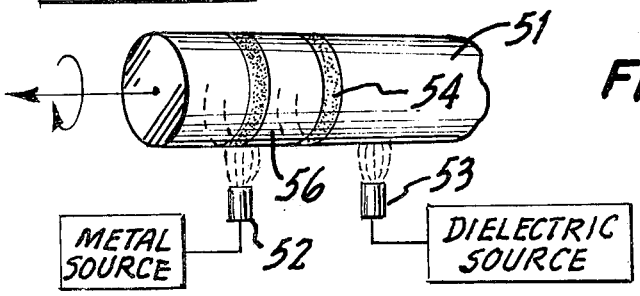
FIG. 7 is a drawing illustrating a method of forming the vacuum housing shown in FIGS. 1–4 by the use of simultaneous plasma deposition of a metallic material and a dielectric material on a rotating mandrel, which is simultaneously translating along the axis of rotation.

FIG. 7 shows yet another way in which the vacuum housing may be fabricated. This third embodiment utilizes a rotating mandrel 51 that rotates past a pair of plasma guns 52 and 53 respectively plasma depositing a layer of metal 54 and a layer of ceramic 56 on the surface of mandrel 51.

The driving mechanism for mandrel 51 rotates the mandrel at a prescribed velocity while simultaneously longitudinally advancing the mandrel so that the plasma guns 52 and 53 respectively lay down intertwined helixes of metal and ceramic, with the desired length, width, pitch and thickness. Again, after completion, the outer surface of the housing is machined or etched to achieve the desired "barber-pole" appearance and the mandrel removed, or chemically dissolved, as previously described.

Of course, in all of the above methods it is necessary to insure proper control of the plasma spray in both time and angle of incidence.

Figure 8:
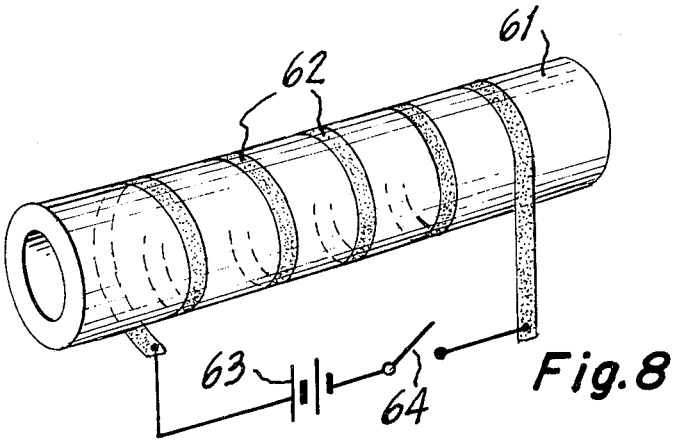
FIGS. 8 and 9 illustrate two methods of forming the cylindrical vacuum housing shown in FIGS. 1–4 by the use of heat sources applied to a cylindrical member of amorphous material.
Figure 9:
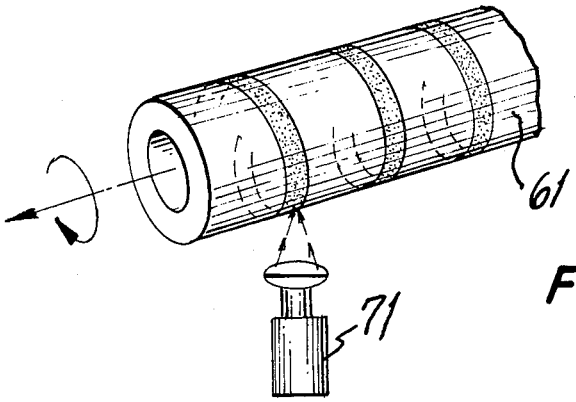

FIG. 8 illustrates yet another method of manufacturing the vacuum housing this time utilizing a material such as amorphous glass. As is well known, amorphous materials can be changed from non-conducting to semi-conducting to fully-conducting by raising the temperature thereof, for example from 50° C. to 600° C. Depending upon the material employed, this change may be reversible or irreversible. As shown in FIG. 8, an elongated cylinder 61, e.g. of amorphous glass, has a resistance tape 62 wound therearound to form the desired helix. The ends of tape 62 are connected to a voltage source 63 via a switch 64. When closed, electrical current will flow through the resistance tape causing localized heating in the amorphous cylinder 61 and producing an irreversible change in the electrical characteristics of the amorphous material from, for example, non-conducting to fully conducting, thereby achieving the desired "barber-pole" configuration for the vacuum housing. In this arrangement, it is advantageous that the amorphous glass have a high bake-out temperature for activation, which changes the crystalline structure from non-conductor to fully conductor. An activation temperature of 600° C. would be adequate since travelling-wave tubes are normally baked-out in a temperature range of from 400° C. to 600° C. The technique described with reference to FIG. 8 has the further advantage that the potential for vacuum leaks is reduced since the metal to dielectric interface in the vacuum housing is eliminated. Also, the vacuum housing is simpler to construct and more suitable to higher frequency operations. By choice of the appropriate amorphous glass material a resistivity of less than 1 ohm/cm., which approaches that of copper, can be obtained. One specific amorphous glass that appers particularly advantageous is a tellurium based glass which has been doped with copper. With this glass, the copper would crystallize out when activated to form the conductive rf circuit. As an alternative to the use of the conductive tape, the arrangement shown in FIG. 9 could be used wherein the glass 61 is raised in temperature by means of a focused beam of radiation from a laser 71. In this arrangement, the amorphous glass cylinder is rotated at a constant velocity while simultaneously linearly translated in much the same manner as the mandrel was moved with reference to FIG. 7. In both FIG. 8 and FIG. 9, the excess untreated glass material in the inner portion of the cylinder is removed by mechanical or chemical etching so that the treated, conductive portions, extend radially inwardly towards the center of the cylinder.

In all of the above fabrication techniques, it is, of course, necessary to leave sufficient room at either end of the cylindrical member to permit the connection of metallization thereto for the appropriate connection of the end caps 14 and 21 respectively housing the electron gun and anode and the collector of the travelling wave tube. In reference to the arrangements in FIGS. 8 and 9, annular rings are activated to crystallize out metal at both ends of the cylinder to facilitate the connection of the end caps 14 and 21.

The fabrication of a ring bar type rf circuit would proceed in precisely the same manner as described above for a helical rf circuit. In addition, the metal ring bar circuit could be made to extend radially inwardly further than the ceramic portion of the vacuum housing in just the same manner that the helical member did.

Figure 10:
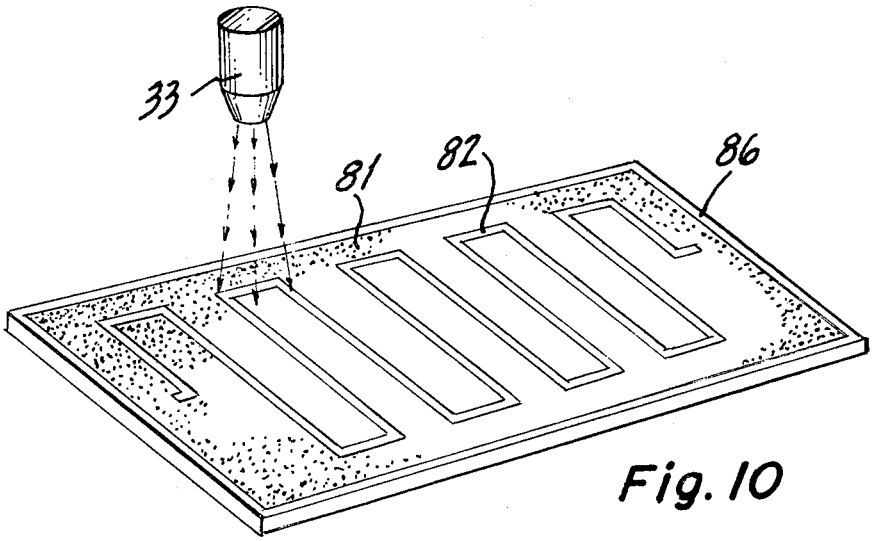
FIG. 10 is a diagram illustrating a method of forming a meanderline-type structure, according to the invention.

FIG. 10 depicts the arrangement that would be used to manufacture a meanderline rf circuit. This arrangement is suitable for use in both a travelling-wave tube and a crossed-field amplifier. As shown, this arrangement is a planar configuration and one or two rf circuits of the type shown in FIG. 10 would be required, on parallel planes, depending upon the particular application. For example, for use in a travelling wave tube, two parallelplane rf circuits would be required. On the other hand, for crossed-field amplifiers, one plane having an rf circuit would be required and a second, parallel plane would be required as the sole electrode. The arrangement depicted in FIG. 10 could be manufactured by any of the methods described above with reference to the cylindrical vacuum housing. However, of course, in those applications that require the mandrel or workpiece to rotate, the movement would be substituted by a movement requiring translation along one axis followed by a translation along a second orthogonal axis, etc. For example, analogous to the technique described in FIG. 5, an aluminum plate 81 having a precut meandering structure 82 formed thereon would be positioned beneath a plasma gun 33 which would spray an appropriate dielectric material over the entire surface of the plate. Next the ceramic would be etched or machined down until the meanderline appeared, i.e. the ceramic would be etched to the depth of the meanderline. The aluminum block would then be removed (chemically or mechanically etched) until the desired structure is achieved. FIG. 10 does not show the other required components such as the cathode, anode and collector which form no part of the invention per se. A metal rim 86 would extend around the periphery of the plate 81 for vacuum sealing purposes.

It should be emphasized that in all the arrangements described, the methods used to attach conventional tube components and other electrical requirements are not given in detail. In particular, the rf ground plane is not shown and also the magnetic focusing structure ordinarily required is omitted. Methods used to cool the tube, for example forced air or forced inert gases, have also not been discussed.

The minimum thickness of the vacuum housing required to obtain and maintain vacuum integrity, and appropriate structural strength, will, of course, depend upon the particular type of tube desired and the particular power level at which it is to operate. However, it has been shown that the thickness of the vacuum housing should be at least 10 mils from most applications. We have also not discussed the types of dielectric material that could be used. Ceramic is, of course, the most likely material; however, certain low-loss glasses and low-loss plastics may also be used under certain circumstances.

A person skilled in the art can make various changes and substitutions to the layout of parts shown without departing from the spirit and the scope of the invention.

What I claim is:

1. A microwave device including an elongated, hollow vacuum housing; means sealing a first end of said housing including a heater, a cathode and an anode extending within said housing; means sealing a second end of said housing including a collector extending within said housing; a conductive helix extending longitudinally between said ends of said vacuum housing and sealed therein, said helix having a given thickness dimension; and means coupling rf energy into and out of said helix, wherein the improvement comprises:

said housing includes a first dielectric portion and a second conductive helix portion, said dielectric portion and said helix portion being sealed together to form a unitary, intertwined, hermetically sealed enclosure, said helix having an inner surface and an outer surface, said inner surface being located within the interior of said vacuum housing for exposure to said vacuum and said outer surface being disposed on the outside of said housing for exposure to the outside atmosphere.

2. The device according to claim 1 wherein said inner surface of said helix extends radially inward to a depth greater than the adjacent inner portions of the intertwined dielectric material.

3. The device according to claim 2 wherein said helix has a trapezoidal cross-section.

4. A microwave vacuum tube enclosure which comprises:

a sealed envelope having electrodes at opposite ends, said envelope including a first longitudinal helix portion of a dielectric material and a second longitudinal helix portion of an electrically conductive material intertwined with and hermetically sealed to said first helix, said helices having at least the same outer lateral dimension, said second helix having an inner surface and an outer surface, said inner surface being exposed to the interior of said envelope and said outer surface being exposed to the outside of said envelope.

5. The device according to claim 4 wherein said second helix extends radially inward to a depth that is greater than adjacent portions of the intertwined dielectric material comprising the first helix.

6. The device according to claim 4 wherein said envelope is cylindrical and said first and second helix portions have alternate turns along the length of said envelope.

7. The device according to claim 1 wherein said means coupling rf energy is coupled to said outer surface of said helix disposed on the outside of said housing.

8. The device according to claim 4 wherein said electrically-conducting material is an electrically-conducting, amorphous glass and said dielectric material is an electrically non-conducting amorphous glass.

* * * * *